US009627755B2

(12) United States Patent
Lin

(10) Patent No.: US 9,627,755 B2
(45) Date of Patent: Apr. 18, 2017

(54) MULTIBAND ANTENNA AND WIRELESS COMMUNICATION DEVICE

(71) Applicant: Chiun Mai Communication Systems, Inc., New Taipei (TW)

(72) Inventor: Yen-Hui Lin, New Taipei (TW)

(73) Assignee: Chiun Mai Communication Systems, Inc., New Taipei (TW)

( * ) Notice: Subject to any disclaimer, the term of this patent is extended or adjusted under 35 U.S.C. 154(b) by 50 days.

(21) Appl. No.: 14/575,685

(22) Filed: Dec. 18, 2014

(65) Prior Publication Data

US 2016/0134017 A1 May 12, 2016

(30) Foreign Application Priority Data

Nov. 6, 2014 (CN) ..... 2014 1 0626080

(51) Int. Cl.

| | |
|---|---|
| ***H01Q 5/378*** | (2015.01) |
| ***H01Q 5/371*** | (2015.01) |
| ***H01Q 5/335*** | (2015.01) |
| ***H01Q 1/24*** | (2006.01) |
| ***H01Q 5/328*** | (2015.01) |

(52) U.S. Cl.

CPC ..... *H01Q 5/335* (2015.01); *H01Q 1/243* (2013.01); *H01Q 5/328* (2015.01); *H01Q 5/371* (2015.01); *H01Q 5/378* (2015.01)

(58) Field of Classification Search

CPC ..... H01Q 5/328; H01Q 5/335; H01Q 5/364; H01Q 5/371; H01Q 5/378; H01Q 5/385; H01Q 5/42; H01Q 5/392; H01Q 5/357; H01Q 5/321; H01Q 5/314; H01Q 5/30; H01Q 1/245; H01Q 1/243; H01Q 1/24

USPC ..... 343/745, 702

See application file for complete search history.

(56) References Cited

U.S. PATENT DOCUMENTS

| | | | | |
|---|---|---|---|---|
| 5,493,702 | A * | 2/1996 | Crowley | H01Q 1/241 343/702 |
| 8,890,753 | B1 * | 11/2014 | Lee | H01Q 1/243 343/702 |
| 8,957,827 | B1 * | 2/2015 | Lee | H01Q 5/321 343/700 MS |
| 9,240,627 | B2 * | 1/2016 | Tseng | H01Q 1/243 |
| 2002/0021248 | A1 * | 2/2002 | Ying | H01Q 1/243 343/700 MS |
| 2003/0052824 | A1 * | 3/2003 | Ollikainen | H01Q 1/243 343/700 MS |
| 2004/0075613 | A1 * | 4/2004 | Jarmuszewski | H01Q 1/243 343/702 |

(Continued)

*Primary Examiner* — Dameon E Levi
*Assistant Examiner* — Awat Salih
(74) *Attorney, Agent, or Firm* — Steven M. Reiss

(57) ABSTRACT

A multiband antenna includes main antenna, a switch circuit, and a parasitic antenna. The main antenna includes a radiating portion, a feeding portion, a grounding portion, and an extending portion coupled to the feeding portion and the grounding portion. The radiating portion is configured to generate a low frequency resonate mode. The switch circuit is configured to regulate an impedance matching characteristic of the multiband antenna, thereby regulating an operating frequency of the low frequency resonate mode. The parasitic antenna is positioned apart from and electromagnetically coupled to the main antenna, and configured to generate a high frequency resonate mode.

16 Claims, 5 Drawing Sheets

(56) References Cited

U.S. PATENT DOCUMENTS

| | | | | |
|---|---|---|---|---|
| 2006/0170600 | A1* | 8/2006 | Korva | H01Q 1/244 343/702 |
| 2007/0069956 | A1* | 3/2007 | Ozkar | H01Q 5/00 343/700 MS |
| 2007/0069958 | A1* | 3/2007 | Ozkar | H01Q 9/0421 343/700 MS |
| 2007/0132641 | A1* | 6/2007 | Korva | H01Q 1/243 343/700 MS |
| 2010/0019973 | A1* | 1/2010 | Yang | H01Q 7/00 343/700 MS |
| 2010/0060528 | A1* | 3/2010 | Chiu | H01Q 1/243 343/700 MS |
| 2012/0242555 | A1* | 9/2012 | Hsieh | H01Q 1/243 343/833 |
| 2013/0038494 | A1* | 2/2013 | Kuonanoja | H01Q 9/145 343/746 |
| 2014/0002308 | A1* | 1/2014 | Chen | H01Q 1/2266 343/700 MS |
| 2014/0062815 | A1* | 3/2014 | Tsai | H01Q 1/243 343/745 |
| 2015/0061960 | A1* | 3/2015 | Liou | H01Q 5/378 343/861 |
| 2015/0123874 | A1* | 5/2015 | Chan | H01Q 9/42 343/905 |
| 2015/0180124 | A1* | 6/2015 | Chen | H01Q 5/335 343/745 |
| 2015/0200456 | A1* | 7/2015 | You | H01Q 9/42 343/722 |

* cited by examiner

MULTIBAND ANTENNA AND WIRELESS COMMUNICATION DEVICE

FIELD

The subject matter herein generally relates to antenna structures, and particularly to a multiband antenna and a wireless communication device employing the multiband antenna.

BACKGROUND

With improvements in the integration of wireless communication systems, antennas have become increasingly important. Multiband antennas are typically used for wireless communication devices that utilize various frequency bandwidths.

BRIEF DESCRIPTION OF THE DRAWINGS

Implementations of the present technology will now be described, by way of example only, with reference to the attached figures.

DETAILED DESCRIPTION

Figure 1:
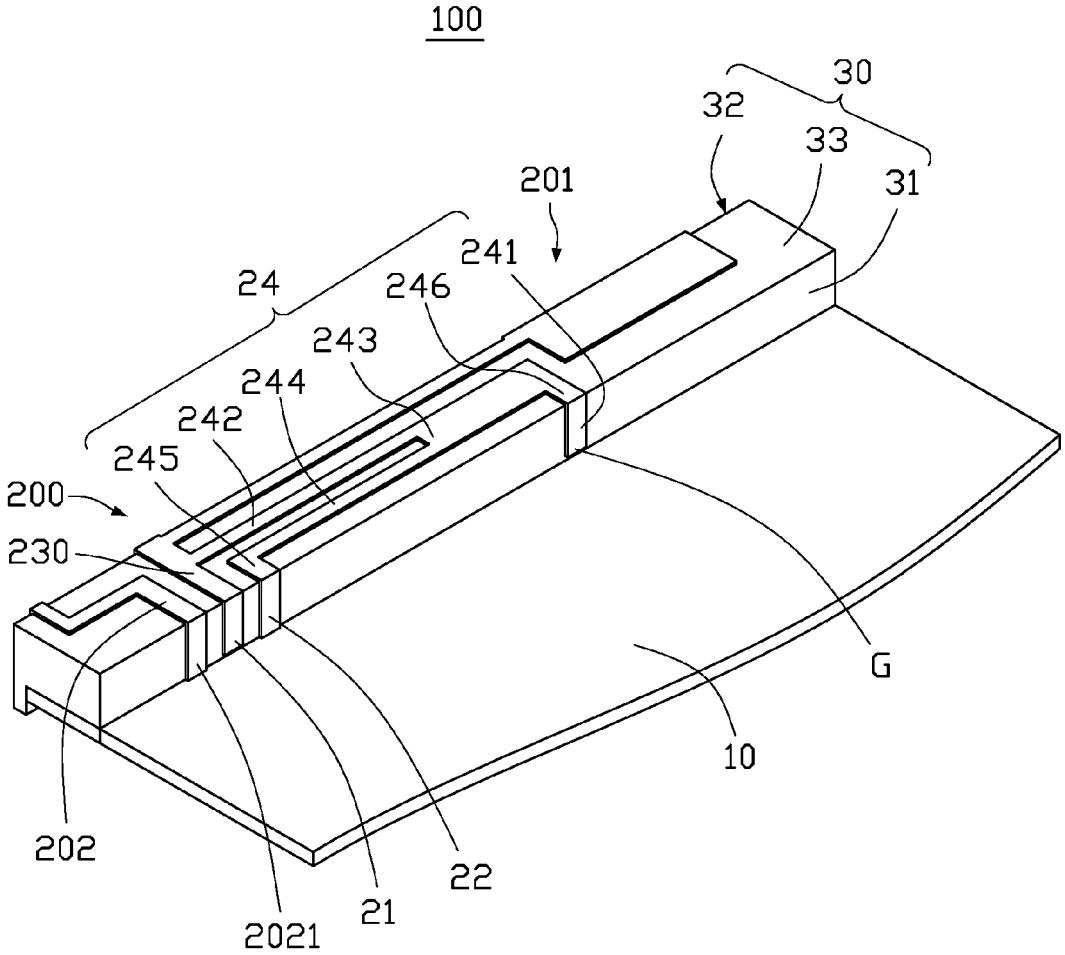
FIG. 1 is an isometric view of one embodiment of a wireless communication device employing a multiband antenna.

It will be appreciated that for simplicity and clarity of illustration, where appropriate, reference numerals have been repeated among the different figures to indicate corresponding or analogous elements. In addition, numerous specific details are set forth in order to provide a thorough understanding of the embodiments described herein. However, it will be understood by those of ordinary skill in the art that the embodiments described herein can be practiced without these specific details. In other instances, methods, procedures and components have not been described in detail so as not to obscure the related relevant feature being described. Also, the description is not to be considered as limiting the scope of the embodiments described herein. The drawings are not necessarily to scale and the proportions of certain parts may be exaggerated to better illustrate details and features of the present disclosure.

Several definitions that apply throughout this disclosure will now be presented.

The term "coupled" is defined as connected, whether directly or indirectly through intervening components, and is not necessarily limited to physical connections. The connection can be such that the objects are permanently connected or releasably connected. The term "substantially" is defined to be essentially conforming to the particular dimension, shape or other word that substantially modifies, such that the component need not be exact. For example, substantially cylindrical means that the object resembles a cylinder, but can have one or more deviations from a true cylinder. The term "comprising" when utilized, means "including, but not necessarily limited to"; it specifically indicates open-ended inclusion or membership in the so-described combination, group, series and the like.

FIG. 1 illustrates an isometric view of one embodiment of a wireless communication device 100, such as a mobile phone or tablet computer. The wireless communication device 100 includes a printed circuit board 10, a multiband antenna 200 and a holder 30 coupled to an end of the printed circuit board 10. The multiband antenna 200 is placed on the holder 30, and electronically coupled to the printed circuit board 10. The multiband antenna 200 includes a main antenna 201, a parasitic antenna 202 electromagnetically coupled to the main antenna 201, and a switching circuit 203 (see FIG. 3) electronically coupled to the main antenna 201.

The main antenna 201 includes a feeding portion 21, a grounding portion 22, a radiating portion 23, and an extending portion 24 coupled to the feeding portion 21 and the grounding portion 22. The feeding portion 21 and the grounding portion 22 are substantially rectangular strip, and are positioned substantially parallel to each other. The holder 30 includes a first surface 31, a second surface 32 substantially parallel to the first surface 31, and a third surface 33 coupled substantially perpendicular to the first and second surfaces 31, 32. The feeding portion 21 and the grounding portion 22 are positioned in the first surface 31. In at least one embodiment, a length of the feeding portion 21 is about 4 mm; a length of the grounding portion 22 is about 4 mm; a distance between the feeding portion 21 and the grounding portion 22 is about 1.5 mm.

The extending portion 24 is substantially a meander strip. In at least one embodiment, the extending portion 24 includes first to sixth extending strips 241, 242, 243, 244, 245 and 246. The first extending strip 241 is positioned in the first surface 31, and parallel to the feeding portion 21 and the grounding portion 22. The ground portion 22 is located between the feeding portion 21 and the first extending strip 241. The first extending strip 241 includes a connecting point G located at a distal end of thereof. The second to sixth extending strips 242, 243, 244, 245 and 246 are positioned in the third surface 33. The second and fourth extending strips 242 and 244 extend substantially perpendicular from two opposite ends of the third extending strip 243, respectively. An end of the second extending strip 242 opposite the third extending strip 243 is coupled to the radiating portion 23. The fifth extending strip 245 is coupled substantially perpendicular between the fourth extending strip 242 and the grounding portion 22. The sixth extending strip 246 is coupled substantially perpendicular between the third extending strip 243 and the first extending strip 241. In at least one embodiment, a distance between the fifth and sixth extending strips 245 and 246 is about 23.5 mm.

Figure 2:
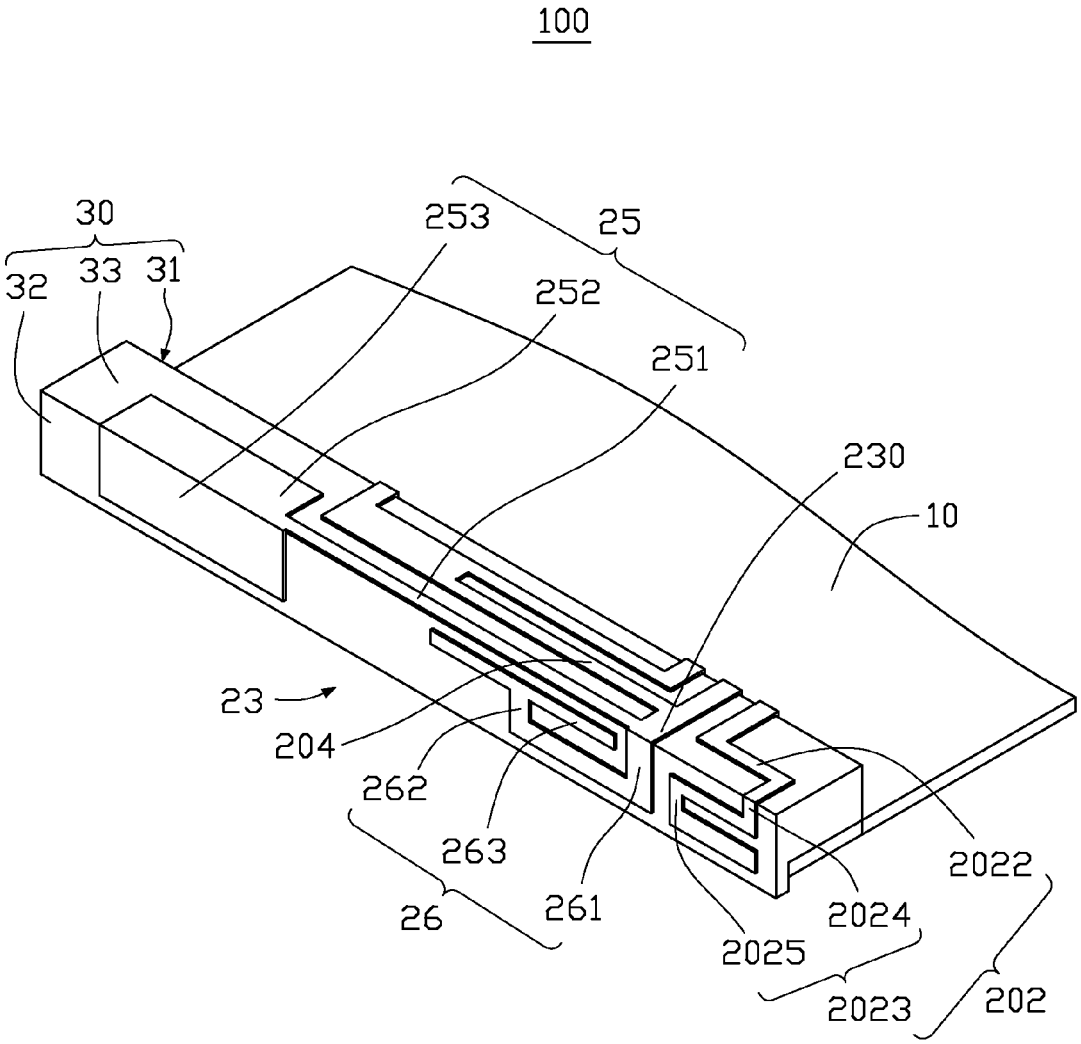
FIG. 2 is similar to FIG. 1, but showing the wireless communication device from another angle.

FIG. 2 is similar to FIG. 1, but showing wireless communication device 100 from another angle. The radiating portion 23 includes a common strip 230, a first branch 25 and a second branch 26. The common strip 230 is coupled to the feeding portion 21 and the extending portion 24. The first and second branches 25 and 26 extend from the common strip 230, the first branch 25 is positioned between and spaced from the common strip 230 and the second branch 26. An electrical length of the first branch 25 is longer than an electrical length of the second branch 26. The parasitic antenna 202 is positioned adjacent to the main antenna 201, and spaced from a side of the common strip 230 opposite the first and second branches 25 and 26. As a result, when current signals output from the printed circuit board 10 are fed to the feeding portion 21, the first branch 25 generates a low frequency resonate mode and a third harmonic resonate mode of the low frequency resonate mode; the second branch 26 is electromagnetically coupled to the first branch 25 to generate a first high frequency resonate mode; the parasitic antenna 202 is electromagnetically fed by the main antenna 201 to generate a second high frequency resonate mode.

In particular, in at least one embodiment, the common strip 230 is positioned on the third surface 33. An end of the common strip 230 is coupled substantially perpendicular to the feeding portion 21 (see FIG. 1), another end of the common strip 230 is coupled to the first and second branches 25 and 26. A side of the common strip 230 is coupled substantially perpendicular to the second extending strip 242 (also see FIG. 1) of the extending portion 24.

The first branch 25 is a substantially meander strip. In at least one embodiment, the first branch 25 includes a first radiating strip 251, a second radiating strip 252 and a third radiating strip 253. An end of the first radiating strip 251 is coupled substantially perpendicular to the common strip 230, another end of the first radiating strip 251 is coupled substantially perpendicular to the second and third radiating strips 252 and 253. The first radiating strip 251 is substantially parallel to the second extending strip 242. In at least one embodiment, a distance between the first radiating strip 251 and the second extending strip 242 is about 1.4 mm. The first and second radiating strips 251 and 252 are positioned on the third surface 33 of the holder 33, and the first radiating strip 251 is narrower than the second radiating strip 252. In at least one embodiment, a total length of the first and second radiating strips 251 and 252 is about 45 mm. The third radiating strip 252 is positioned on the second surface 32 of the holder 30, and is wider than the first radiating strip 251.

The second branch 26 is substantially a meander strip, and is positioned on the second surface 32. In at least one embodiment, the second branch 26 includes a fourth radiating strip 261, a fifth radiating strip 262 and a third radiating strip 263. The fourth radiating strip 261 is substantially L-shaped. An end of the fourth radiating strip 261 is coupled substantially perpendicular to the common strip 230. The fifth radiating strip 262 is coupled substantially perpendicular to both the fourth and sixth radiating strips 261 and 263. In particular, the fifth radiating strip 262 is coupled to a middle portion of the sixth radiating strip 263. The sixth radiating strip 263 is spaced from and substantially parallel to the first radiating strip 251. In at least one embodiment, a length of the sixth radiating strip 263 is about 13.5 mm; a distance between the sixth radiating strip 263 and the first radiating strip 251 is about 1 mm. A frequency band of the first high frequency resonate mode can be regulated by regulating the length of the sixth radiating strip 263.

The parasitic antenna 202 is substantially a meander strip, and is positioned on the first, second and third surfaces 31, 32 and 33 of the holder 30. In particular, the parasitic antenna 202 includes a first parasitic portion 2021 (see FIG. 1), a second parasitic portion 2022 and a third parasitic portion 2023 which are coupled sequentially. The first parasitic portion 2021 (see FIG. 1) is substantially a rectangular strip which is positioned on the first surface 31 of the holder 30. The first parasitic portion 2021 and the grounding portion 22 are located at two opposite sides of the feeding portion 21. The first parasitic portion 2021 can be electronically coupled to the printed circuit board 10, and can be grounded via the printed circuit board 10. The second parasitic portion 2022 is substantially a meander strip, and is positioned on the third surface 33 of the holder 33 and adjacent to the common strip 230. In particular, the second parasitic portion 2022 is substantially Z-shaped. The third parasitic portion 2023 is substantially a meander strip, and is positioned on the second surface 32 of holder 30 and adjacent to the second branch 26. In particular, the third parasitic portion 2023 includes a first parasitic arm 2024 and a second parasitic arm 2025. The first parasitic arm 2024 is substantially a rectangular strip, and is coupled between the second parasitic portion 2022 and the second parasitic arm 2025. The second parasitic arm 2025 is substantially U-shaped. In at least one embodiment, a total length of the parasitic antenna 202 is about 33 mm.

Figure 3:
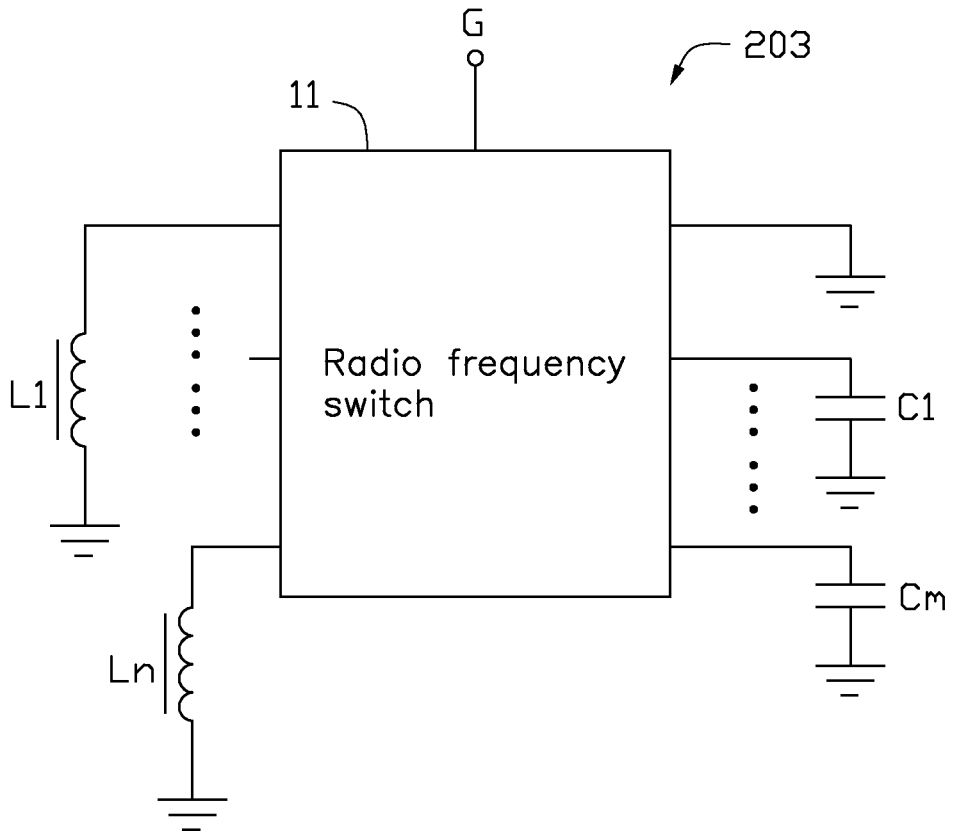
FIG. 3 is a circuit diagram of a switching circuit of the multiband antenna as shown in FIG. 1.

FIG. 3 illustrates a circuit diagram of the switching circuit 203 of the multiband antenna 200. The switching circuit 203 is electronically coupled to the grounding point G of the extending portion 24 as shown in FIG. 1. The switching circuit 203 is configured to regulate an impedance matching characteristic of the multiband antenna 200, to regulate the low frequency resonate mode, such that low frequency bandwidth can be broadened. The switching circuit 203 includes a radio frequency switch 11, at least one capacitor, and at least one inductor. The at least one capacitor and the at least one inductor are grounded. The radio frequency switch 11 is capable of being grounded directly. The radio frequency switch 11 is configured to selectively short or open the grounding point G, or couple different value capacitors and different value inductors to the grounding point G, to regulate the impedance matching characteristic of the grounding point G. In at least one embodiment, the switching circuit 203 includes n inductors L1-Ln with different inductance and m capacitors C1-Cm with different capacitance. Thus, by the switch of the radio frequency switch 11, the inductance value and capacitance value electronically coupled to the grounding point G can be regulated.

Figure 4:
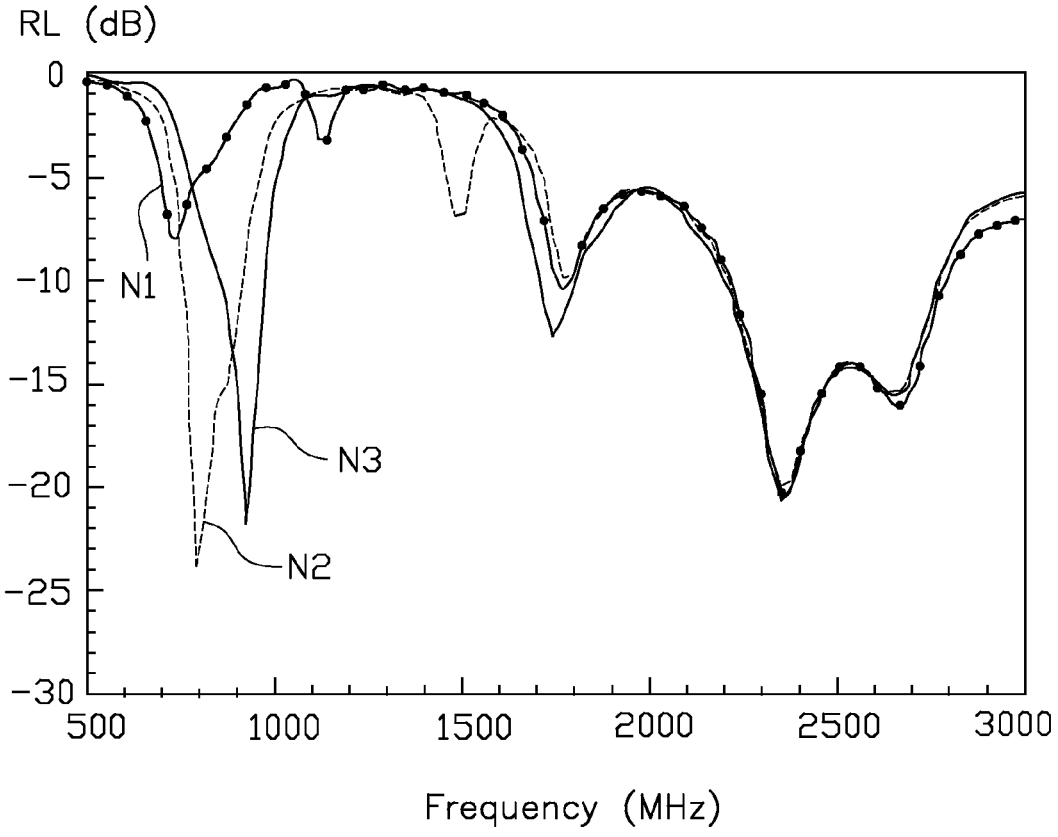
FIG. 4 is a diagram showing return loss ("RL") measurements of the multiband antenna as shown in FIG. 1.

FIG. 4 illustrates a diagram showing RL measurements of the multiband antenna 200. Curve N1 represents a RL of the multiband antenna 200 when a 1 pF capacitor is electronically coupled to the grounding point G. Curve N2 represents a RL of the multiband antenna 200 when the grounding point G is opened by the radio frequency switch 11. Curve N3 represents a RL of the multiband antenna 200 when a 15 nH inductor is electronically coupled to the grounding point G. It can be derived from FIG. 4 that, when the 1 pF capacitor is electronically coupled to the grounding point G, the low frequency resonate mode generated by the first branch 25 operates at about 700 MHz; when the grounding point G is opened by the radio frequency switch 11, the low frequency resonate mode generated by the first branch 25 operates at about 750-850 MHz; and when the 15 nH inductor is electronically coupled to the grounding point G, the low frequency resonate mode generated by the first branch 25 operates at about 920 MHz. Accordingly, by the switch of the radio frequency switch 11, the operating frequency of the low frequency resonate mode is regulated, and thus the low frequency bandwidth is broadened.

Figure 5:
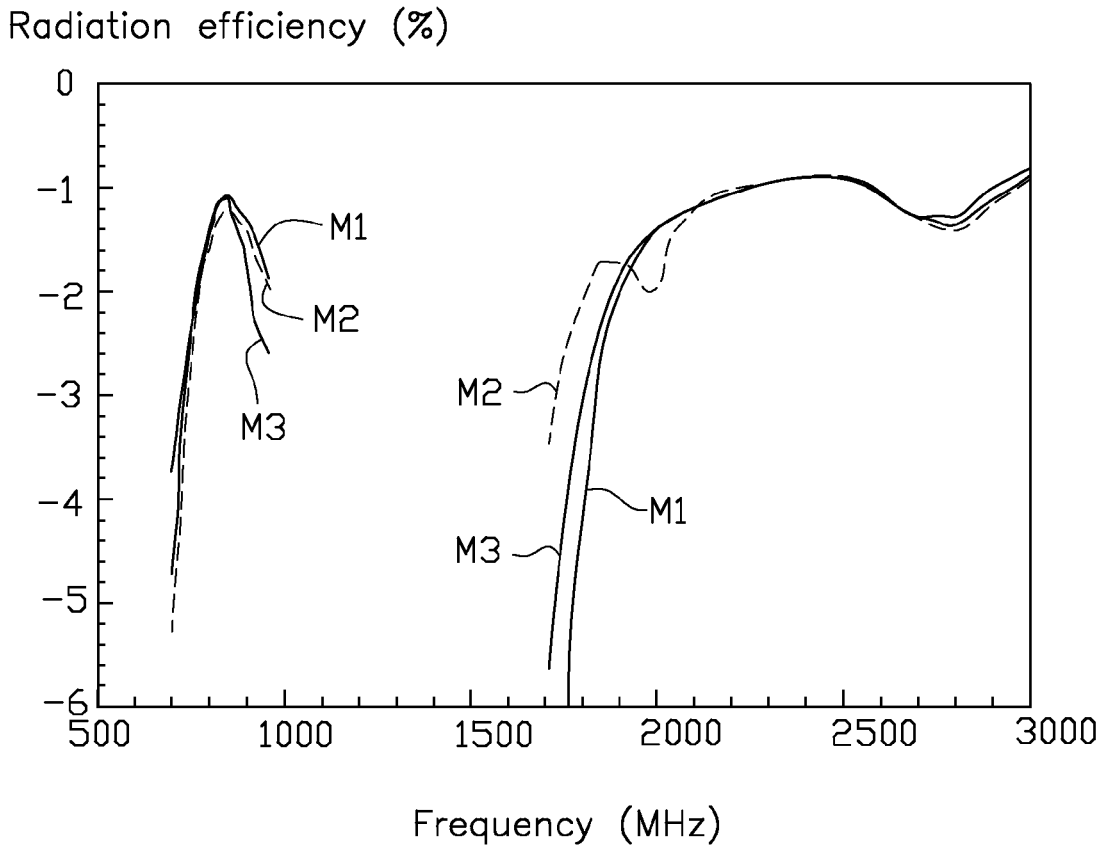
FIG. 5 is a diagram showing transmission efficiency measurements of the multiband antenna as shown in FIG. 1.

FIG. 5 illustrates a diagram showing transmission efficiency measurements of the multiband antenna 200. Curve M1 represents a transmission efficiency of the multiband antenna 200 when the grounding point G is opened by the radio frequency switch 11. Curve M2 represents a transmission efficiency of the multiband antenna 200 when a 15 nH inductor is electronically coupled to the grounding point G. Curve M3 represents a transmission efficiency of the multiband antenna 200 when a 1 pF capacitor is electronically coupled to the grounding point G. It can be derived from FIG. 5 that no matter which impedance matching characteristic is selected, the transmission efficiency is greater than −4 dB when the multiband antenna 200 operates at a low frequency band from about 704 MHz to about 960 MHz, and the transmission efficiency is greater than −3 dB when the multiband antenna 200 operates at a low frequency band from about 1710 MHz to about 2690 MHz. Accordingly, the multiband antenna 200 can be utilized in common wireless communication systems, such as GSM850/EGSM900/DCS1800/PCS1900/UMTS/LTE2300, with an exceptional communication quality.

The embodiments shown and described above are only examples. Many details are often found in the art. Therefore, many such details are neither shown nor described. Even though numerous characteristics and advantages of the present technology have been set forth in the foregoing description, together with details of the structure and function of the present disclosure, the disclosure is illustrative only, and changes may be made in the detail, including in matters of shape, size and arrangement of the parts within the principles of the present disclosure up to, and including the full extent established by the broad general meaning of the terms used in the claims. It will therefore be appreciated that the embodiments described above may be modified within the scope of the claims.

What is claimed is:

1. A multiband antenna comprising:

a main antenna comprising a radiating portion, a feeding portion, a grounding portion, and an extending portion coupled to the feeding portion and the grounding portion; the radiating portion configured to generate a low frequency resonant mode;

wherein the radiating portion comprises a common strip, a first branch, and a second branch, the first branch and second branch extend from the common strip, the common strip extends from the feeding portion and spaced from the grounding portion;

wherein the first branch is substantially a meander strip, and comprises a first radiating strip, a second radiating strip, and a third radiating strip; an end of the first radiating strip is coupled substantially perpendicular to the common strip, another end of the first radiating strip is coupled substantially perpendicular to both the second and third radiating strips; the first radiating strip is substantially coplanar with the second radiating strip; the third radiating strip is coupled to the second radiating strip, and is positioned in a plane that is substantially perpendicular to a plane in which the second radiating strip is positioned;

a switch circuit electronically coupled to the extending portion, and configured to regulate an impedance matching characteristic of the multiband antenna, thereby regulating an operating frequency of the low frequency resonant mode; and a parasitic antenna positioned apart from and electromagnetically coupled to the main antenna, and configured to generate a high frequency-resonant mode.

2. The multiband antenna of claim 1, wherein the first branch is positioned between the second branch and the extending portion; the parasitic antenna is positioned adjacent to and spaced from another side of the common strip opposite the first and second branches.

3. The multiband antenna of claim 2, wherein an electrical length of the first branch is longer than an electrical length of the second branch; the first branch is configured to generate the low frequency resonant mode and a third harmonic resonant mode of the low frequency resonant mode; the second branch is configured to electromagnetically couple to the first branch to generate a first high frequency mode; the parasitic antenna is configured to electromagnetically couple to the main antenna to generate a second high frequency mode.

4. The multiband antenna of claim 2, wherein the switch circuit comprises a radio frequency switch, at least one capacitor and at least one inductor; the radio frequency switch is electronically coupled to the extending portion, the at least one capacitor, and the at least one inductor; the at least one capacitor and the at least one inductor are grounded; the radio frequency switch is configured to either short or open the extending portion, and further configured to electronically couple either the at least one capacitor or the at least one inductor to the extending portion.

5. The multiband antenna of claim 1, wherein the extending portion is substantially a meander strip, and comprises a first extending strip, a second extending strip, a third extending strip, a fourth extending strip, a fifth extending strip, and a sixth extending strip; the first extending strip is substantially coplanar with and parallel to both the grounding portion and the feeding portion, and further electronically coupled to the switch circuit; the second to sixth extending strips are positioned in a plane that is substantially perpendicular to a plane in which the first extending strip is positioned; the second and fourth strips extend substantially perpendicular from two opposite ends of the third extending strip respectively; an end of the second extending strip away from the third extending strip is coupled to the radiating portion; the fifth extending strip is coupled between the fourth extending strip and the grounding portion, and is substantially perpendicular to both the fourth extending strip and the grounding portion; the sixth extending strip is coupled between the third extending strip and the first extending strip.

6. The multiband antenna of claim 1, wherein the common strip is positioned in a plane that is substantially perpendicular to a plane in which the feeding portion is positioned; an end of the common strip is coupled to the feeding portion, another end of the common strip is coupled to both the first and second branches.

7. The multiband antenna of claim 1, wherein the second branch is substantially a meander strip, and comprises a fourth radiating strip, a fifth radiating strip, and a sixth radiating strip; the fourth radiating strip is substantially L-shaped, an end of the fourth radiating strip is coupled substantially perpendicular to the common strip; the fifth radiating strip is coupled substantially perpendicular to both the fourth and sixth radiating strips; the sixth radiating strip is spaced from and substantially parallel to the first radiating strip.

8. The multiband antenna of claim 6, wherein the parasitic antenna is a substantially meander strip, and comprises a first parasitic portion, a second parasitic portion and a third parasitic portion that are coupled sequentially; the first parasitic portion is substantially coplanar with the feeding portion, and configured to be coupled to ground; the second parasitic portion is a substantially meander strip, and substantially coplanar with the common strip; the third parasitic portion is a substantially meander strip, and substantially coplanar with the second branch.

9. A wireless communication device comprising:

a multiband antenna comprising:

a main antenna comprising a radiating portion, a feeding portion, a grounding portion, and an extending portion coupled to the feeding portion and the grounding portion; the radiating portion configured to generate a low frequency resonant mode;

wherein the radiating portion comprises a common strip, a first branch, and a second branch, the first branch and second branch extend from the common strip, the common strip extends from the feeding portion and spaced from the grounding portion;

wherein the first branch is substantially a meander strip, and comprises a first radiating strip, a second radiating strip, and a third radiating strip; an end of the first radiating strip is coupled substantially perpendicular to the common strip, another end of the first radiating strip is coupled substantially perpendicular to both the second and third radiating strips; the first radiating strip is substantially coplanar with the second radiating strip; the third radiating strip is coupled to the second radiating strip, and is positioned in a plane that is substantially perpendicular to a plane in which the second radiating strip is positioned;

a switch circuit electronically coupled to the extending portion, and configured to regulate an impedance matching characteristic of the multiband antenna, thereby regulating an operating frequency of the low frequency resonant mode; and a parasitic antenna positioned apart from and electromagnetically coupled to the main antenna, and configured to generate a high frequency resonant mode; and a printed circuit board electronically coupled to the feeding portion and the grounding portion, and configured to feed current signal to the feeding portion.

10. The wireless communication device of claim 9, wherein the first branch is positioned between the second branch and the extending portion; the parasitic antenna is positioned adjacent to and spaced from another side of the common strip opposite the first and second branches.

11. The wireless communication device of claim 10, wherein an electrical length of the first branch is longer than an electrical length of the second branch; the first branch is configured to generate the low frequency resonant mode and a third harmonic resonant mode of the low frequency resonant mode; the second branch is configured to electromagnetically couple to the first branch to generate a first high frequency mode; the parasitic antenna is configured to electromagnetically couple to the main antenna to generate a second high frequency mode.

12. The wireless communication device of claim 9, wherein the switch circuit comprises a radio frequency switch, at least one capacitor and at least one inductor; the radio frequency switch is electronically coupled to the extending portion, the at least one capacitor and the at least one inductor; the at least one capacitor and the at least one inductor are grounded; the radio frequency switch is configured to either short or open the extending portion, and further configured to electronically couple either the at least one capacitor or the at least one inductor to the extending portion.

13. The wireless communication device of claim 9, wherein the extending portion is substantially a meander strip, and comprises a first extending strip, a second extending strip, a third extending strip, a fourth extending strip, a fifth extending strip, and a sixth extending strip; the first extending strip is substantially coplanar with and parallel to both the grounding portion and the feeding portion, and further electronically coupled to the switch circuit; the second to sixth extending strips are positioned in a plane that is substantially perpendicular to a plane in which the first extending strip is positioned; the second and fourth strips extend substantially perpendicular from two opposite ends of the third extending strip respectively; an end of the second extending strip away from the third extending strip is coupled to the radiating portion; the fifth extending strip is coupled between the fourth extending strip and the grounding portion, and is substantially perpendicular to both the fourth extending strip and the grounding portion; the sixth extending strip is coupled between the third extending strip and the first extending strip.

14. The wireless communication device of claim 9, wherein the common strip is positioned in a plane that is substantially perpendicular to a plane in which the feeding portion is positioned; an end of the common strip is coupled to the feeding portion, another end of the common strip is coupled to both the first and second branches.

15. The wireless communication device of claim 9, wherein the second branch is substantially a meander strip, and comprises a fourth radiating strip, a fifth radiating strip, and a sixth radiating strip; the fourth radiating strip is substantially L-shaped, an end of the fourth radiating strip is coupled substantially perpendicular to the common strip; the fifth radiating strip is coupled substantially perpendicular to both the fourth and sixth radiating strips; the sixth radiating strip is spaced from and substantially parallel to the first radiating strip.

16. The wireless communication device of claim 14, wherein the parasitic antenna is substantially a meander strip, and comprises a first parasitic portion, a second parasitic portion and a third parasitic portion that are coupled sequentially; the first parasitic portion is substantially coplanar with the feeding portion, and configured to be coupled to ground; the second parasitic portion is substantially a meander strip, and substantially coplanar with the common strip; the third parasitic portion is substantially a meander strip, and substantially coplanar with the second branch.

* * * * *